United States Patent [19]

Petersen

[11] Patent Number: 4,913,054

[45] Date of Patent: Apr. 3, 1990

[54] PROJECTILE DELIVERY APPARATUS

[75] Inventor: Donald W. Petersen, Tehachapi, Calif.

[73] Assignee: Dynafore Corporation, Tehachapi, Calif.

[21] Appl. No.: 59,554

[22] Filed: Jun. 8, 1987

[51] Int. Cl.[4] ..... F42B 11/00

[52] U.S. Cl. ..... 102/439; 102/448; 102/455; 102/457; 102/496; 102/506; 102/515; 102/517

[58] Field of Search ..... 102/438, 439, 448, 455, 102/457, 491, 494, 495, 496, 501, 506, 517, 518, 519, 514, 515, 516

[56] References Cited

U.S. PATENT DOCUMENTS

| | | | |
|---|---|---|---|
| 2,995,090 | 8/1961 | Daubenspeck . | |
| 3,058,420 | 10/1962 | Tanner et al. . | |
| 3,059,578 | 10/1962 | Hegge et al. . | |
| 3,298,308 | 1/1967 | Throner, Jr. . | |
| 3,570,406 | 3/1971 | Trey . | |
| 3,861,311 | 1/1975 | Bilsbury . | |
| 3,898,933 | 9/1975 | Castera et al. . | |
| 3,902,683 | 2/1975 | Bilsbury | 102/518 |
| 3,972,286 | 8/1976 | Canon | 102/518 |
| 4,108,073 | 8/1978 | Davis | 102/520 |
| 4,187,783 | 12/1980 | Campoli et al. | 102/520 |
| 4,353,305 | 10/1982 | Moreau et al. | 102/520 |
| 4,603,637 | 8/1986 | Snide et al. . | |
| 4,633,782 | 1/1987 | Berube et al. | 102/518 |
| 4,649,829 | 3/1987 | Bilsbury | 102/520 |

FOREIGN PATENT DOCUMENTS

| | | | |
|---|---|---|---|
| 133076 | 10/1919 | United Kingdom | 102/496 |
| 887124 | 1/1962 | United Kingdom | 102/517 |
| 2128299 | 4/1984 | United Kingdom . | |

*Primary Examiner*—Harold J. Tudor
*Attorney, Agent, or Firm*—Godfrey Kahn

[57] ABSTRACT

A projectile delivery apparatus for enhancing the penetration capability of a projectile including a friable capsule, which traverses the distance from a firearm to a preselected target while retaining the launch weight of the projectile intact, and a projectile, which is mounted internally of the friable capsule and is released from the capsule to achieve increased penetration of the target.

3 Claims, 2 Drawing Sheets

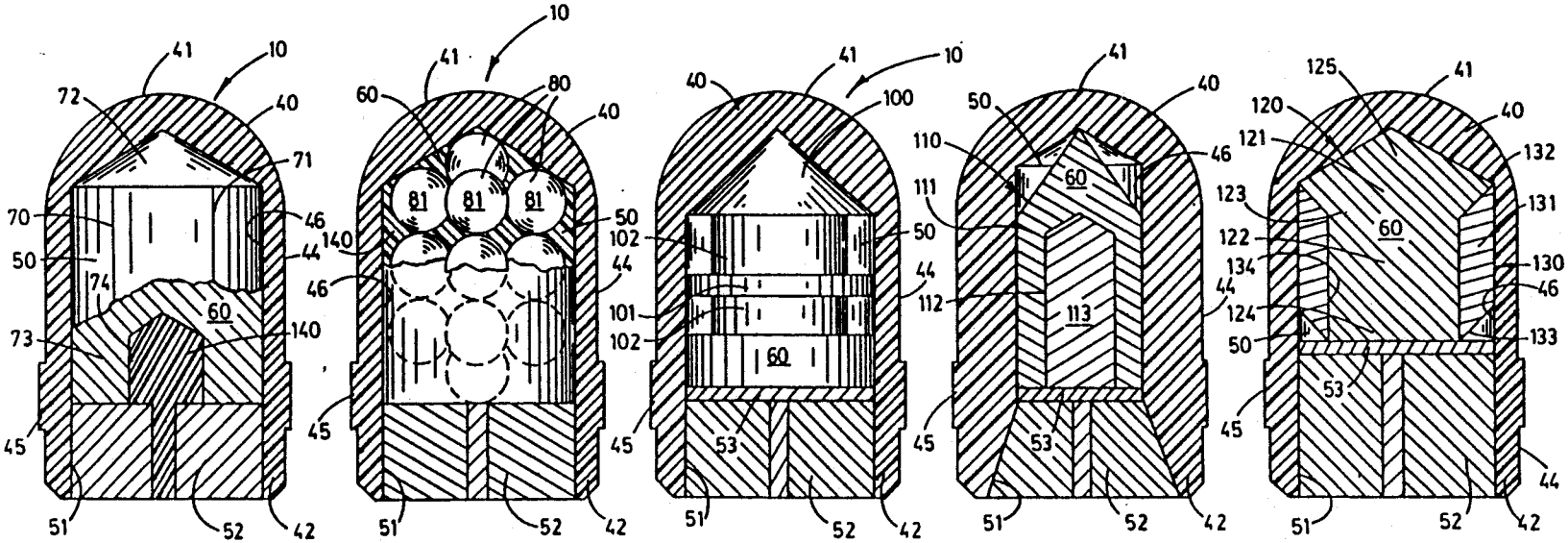
FIG. 5B
FIG. 5C
FIG. 5D
FIG. 5E
FIG. 5F
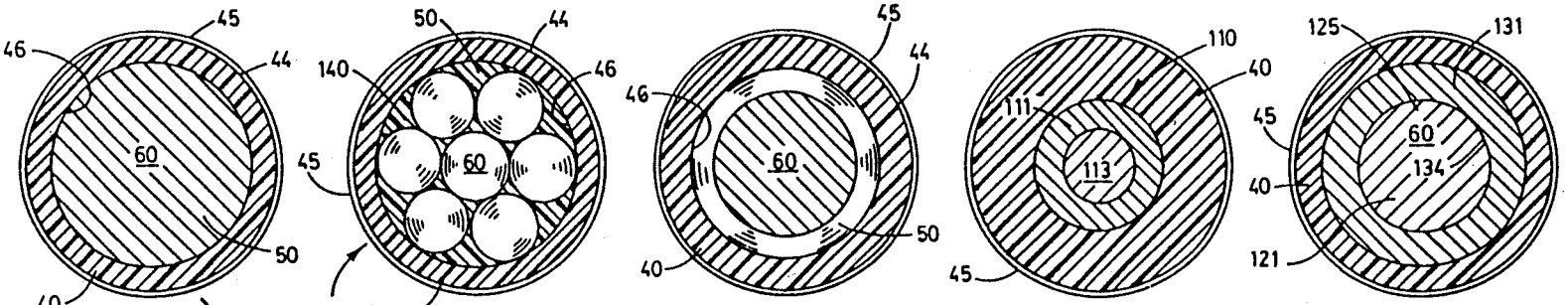
FIG. 6B
FIG. 6C
FIG. 6D
FIG. 6E
FIG. 6F

PROJECTILE DELIVERY APPARATUS

BACKGROUND OF THE INVENTION

1. Field of the Invention:

The present invention relates to a projectile delivery apparatus and more particularly to such an apparatus which imparts improved penetration characteristics to a projectile so delivered to a preselected target, the apparatus enclosing the projectile in a friable capsule, and adapted to traverse the distance from the firearm to the target while retaining the launch weight of the projectile intact.

2. Description of the Prior Art:

Weapons development, and more particularly the development of improved projectiles which are adapted to penetrate hardened targets composed of a variety of different compositions for the purpose of destroying, or otherwise disabling the target to achieve military or police objectives has long been an extremely fertile area for research and development activity.

There are a variety of tactical situations where police and military personnel must, from time to time, utilize variously designed projectiles against a hardened target. When these situations develop, the projectile of choice can change from one instance to the next, due in part to a fluid tactical environment, or the need to engage assorted targets at ever changing distances. It should be understood that the selection of the wrong projectile can potentially jeopardize the success of any operation undertaken. For example, an armor piercing projectile may be utilized for purposes of disabling a vehicle, or alternatively may be used to penetrate a hardened target to disable an assailant. The prior art devices designed for such purposes have suffered from several chronic problems which have prevented their being utilized except in very narrow circumstances. It is well known, for example, that commercially available armor piercing projectiles have significant range and therefore should not be employed in a built-up environment where the projectile could perhaps pass through the hardened target and continue on into areas where innocent bystanders may be present.

In light of the shortcomings recognized in commercially available armor piercing projectiles, police and special forces military units have sought after a projectile for use in a close assault weapon which is capable of penetrating hardened targets, but similarly does not have the deleterious characteristic of propelling the projectile for significant distances. This feature is highly desirable in those tactical situations where the target to be engaged is near by, for example, in distances of 100 yards or less. Heretofore, the close assault weapon of choice for engaging personnel targets in short distances has been the shotgun. Typically, double aught buck (00) rounds are employed for this purpose.

Although a shotgun utilizing a double aught buck round is highly effective against personnel targets, its ability to penetrate a hardened target is quite limited. The inability of a double aught buck round to penetrate a hardened target is influenced by numerous factors, including a multiplicity of aerodynamic forces which act on the projectile itself.

Of the numerous aerodynamic forces acting on a projectile which is fired from a weapon, one which is always present is drag, or air resistance to forward motion. Resistance to the motion of a body through a fluid such as air derives from the fact that the body must move the fluid out of its way. The fluid particles are accelerated as the forward moving body collides with them opposing the motion of the body and robbing it of some of its energy. The drag is a function of the density of the fluid, and the area and velocity of the body propelled therethrough. The effect of the drag is to modify the theoretical vacuum trajectory so that the projectile falls short of the impact point it would have reached had it traveled in a vacuum.

A number of highly complex aerodynamic properties are operating when an axially symmetrical projectile is propelled out of a weapon. The most notable ones, drag, pitching moment, damping in pitch, and lift forces are usually the most important ones acting on the projectile. Other forces may also be present. These forces include rolling moments, that is moments tending to spin or retard the spin of the projectile about a longitudinal axis, pitching and yawing moments induced by deflected control surfaces, and magnus forces and magnus moments, that is moments about the pitch and yaw axes due to rotation about the roll axis.

The effect of drag and these other various forces on small projectiles, such as that utilized in a double aught (00) buck shotgun round tends to inhibit the round's hardened target penetration capability. Moreover, the ability to propel the projectile accurately at a preselected target is determined, to some degree upon the firearm's ability to stabilize the projectile in flight.

In order to stabilize the projectile in flight, the projectile is frequently spun about its longitudinal axis. The resulting gyroscopic stabilization keeps the projectile from tumbling and maintains the proper orientation in flight to keep drag at a minimum. The spin of a projectile is imparted by the rifling of the gun barrel. While the spin does tend to stabilize the orientation, in practice, the spin axis will precess so that the nose of the projectile follows a spiral path. Some further problems are introduced by spinning the projectile inasmuch as the spin, in stabilizing the orientation of the projectile along the original trajectory, causes the projectile to arrive at the point of impact at an undesirable inclination. This further inhibits the ability of the projectile to penetrate the preselected target.

Therefore, it has long been known that it would be desirable to have a projectile delivery apparatus which can be fired accurately from a conventionally designed shotgun and which is adapted to traverse the distance from the shotgun to the target while retaining the launch weight of the projectile intact, and more particularly a projectile delivery apparatus wherein the projectile is released when it engages a preselected target in a manner imparting improved penetration characteristics.

OBJECTS AND SUMMARY OF THE INVENTION

Therefore, it is an object of the present invention to provide an improved projectile delivery apparatus.

Another object is to provide such an apparatus which is particularly well suited to transporting a variety of different projectiles from the breech of a firearm, the apparatus adapted to preserve the launch weight of such projectiles intact until impact with a preselected target.

Another object is to provide such an apparatus which is operable to mount a plurality of projectiles in a preselected pattern, the apparatus controlling the dispersion pattern and the depth of penetration of the projectile upon impact with a preselected target.

Another object is to provide such an apparatus wherein the apparatus becomes rapidly pliable upon impact with the target thus enhancing projectile penetration of the target.

Another object is to provide such an apparatus which is characterized by ease of employment, simplicity of construction, and which can be manufactured and sold at a nominal price.

Another object is to provide such an apparatus which improves the directional flight and stability of the projectile so delivered.

Another object is to provide such an apparatus which is operable to obtain the individual benefits to be derived from similar prior art devices while avoiding the detriments individually associated therewith.

Further objects and advantages are to provide improved elements and arrangements thereof in an apparatus for the purposes described which is dependable, durable, and effective in accomplishing its intended purposes.

These and other objects and advantages are achieved in a projectile delivery apparatus of the present invention where, in the preferred embodiment, a friable capsule mounts a projectile which is propelled from a firearm to a preselected target, the friable capsule maintaining the launch weight of the projectile intact, and releasing the projectile upon impact to achieve improved projectile penetration of the target.

BRIEF DESCRIPTION OF THE DRAWINGS

FIG. 5B is a somewhat enlarged, longitudinal section of the apparatus taken along line 5—5 of FIG. 4 and showing the second form of the apparatus mounting a lead slug.

FIG. 5C is a somewhat enlarged, longitudinal section of the apparatus taken along line 5—5 of FIG. 4 and showing the third form of the apparatus mounting a plurality of round shot.

FIG. 5D is a somewhat enlarged, longitudinal section of the apparatus taken along line 5—5 of FIG. 4 and showing the fifth form of the subject apparatus mounting a mini-ball.

FIG. 5E is a somewhat enlarged, longitudinal section of the apparatus taken along line 513 5 of FIG. 4 and showing the sixth form of the apparatus mounting a modified single penetrator.

FIG. 5F is a somewhat enlarged, longitudinal section of the apparatus taken along line 5—5 of FIG. 4 and showing the seventh form of the apparatus mounting a lead slug housed in a steel jacket.

FIG. 6B is a somewhat enlarged, transverse section taken on line 6—6 of FIG. 4 and showing the second form of the apparatus mounting a lead slug.

FIG. 6C is a somewhat enlarged, transverse section taken on line 6—6 of FIG. 4 and showing the third form of the apparatus mounting a plurality of round shot.

FIG. 6D is a somewhat enlarged, transverse section taken on line 6—6 of FIG. 4 and showing the fifth form of the apparatus mounting a mini-ball.

FIG. 6E is a somewhat enlarged, transverse section taken on line 6—6 of FIG. 4 and showing the sixth form of the apparatus mounting a modified single penetrator.

FIG. 6F is a somewhat enlarged, transverse section taken on line 6—6 of FIG. 4 and showing the seventh form of the apparatus mounting a lead slug housed in a steel jacket.

DESCRIPTION OF THE PREFERRED EMBODIMENT FIRST FORM

Figures 1, 2, 3, 4, 5A, 6A:
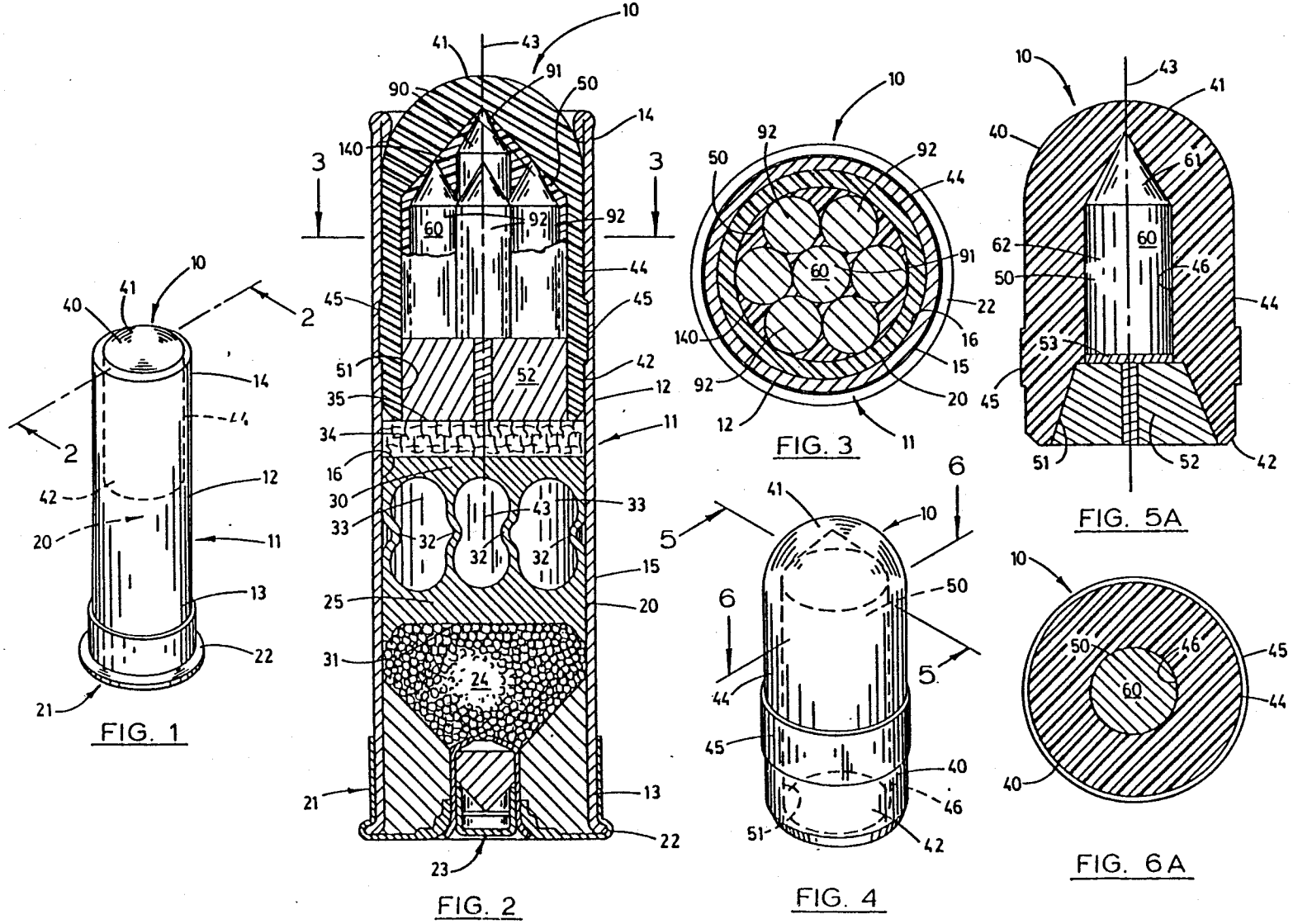
FIG. 1 is a perspective view of the projectile delivery apparatus of the subject invention shown in typical operative configuration.
FIG. 2 is a somewhat enlarged, longitudinal section of the fourth form of the subject invention taken on line 2—2 of FIG. 1.
FIG. 3 is a somewhat enlarged, transverse horizontal section of the fourth form of the subject invention taken from a position indicated by line 3—3 of FIG. 2.
FIG. 4 is a second perspective view of the apparatus of the subject invention with the underlying internal chamber thereof shown in hidden lines.
FIG. 5A is a somewhat enlarged, longitudinal section of the apparatus taken along line 5—5 of FIG. 4 and showing the first form of the apparatus mounting a single penetrator.
FIG. 6A is a somewhat enlarged, transverse section taken on line 6—6 of FIG. 4 and showing the first form of the apparatus mounting a single penetrator.

Referring more particularly to the drawings, the projectile delivery apparatus embodying the principles of the present invention is generally indicated by the numeral 10 in FIG. 1. It should be understood that the apparatus 10 is propelled out of a shotgun, not shown, by a conventionally configured shotgun cartridge generally indicated by the numeral 11. The shotgun cartridge has a casing 12, which typically is manufactured out of a plastic material, and which further has a first end 13, a second end 14, an outside surface 15, and an inside surface 16 which defines a void 20. Mounted to the first end of the casing is a base 21 which defines an annular flange 22 which is operable to engage the shotgun when the shotgun cartridge is chambered. A primer, generally indicated by the numeral 23 is mounted substantially centrally of the base and is adapted to ignite the propellant or gun powder 24 which is disposed in close proximity to the primer.

The combustion mechanism of the gun powder 24, which is termed "deflagration", is well understood and is typically referred to as a "cigarette type burn". The process which entails heating the surface of the propellant by radiation and conduction causes the surface material of the propellant to evaporate and decompose. In this way, a stream of gas, not shown, is produced to create a steady state in the casing 12. The burning rate of the propellant is calculated as the rate with which the propellant surface recedes. The rate of gas production is roughly proportional to the product of the surface area of the unconsumed propellant and the pressure in the chamber. It should be understood, therefore, that the production of gas is quite rapid, the pressure in the gun breech, not shown, reaching a maximum value of approximately 50,000 PSI in as little as 1 or 2 msec. after the ignition of the propellant by the primer.

A modified shot cup, plastic powder cup, or air wedge, generally indicated by the numeral 25 is adapted to be received slidably in sealably secure mating relation internally of the void 20. The shot cup, which is of conventional design, has a top surface 30, and a bottom surface 31. The top and bottom surface are joined together by a plurality of support members 32. The top and bottom surfaces define an air space 33 which is adapted partially to reduce the recoil of the shotgun. The top surface 30 mounts a felt pad 34 which is also operable partially to reduce the recoil. The felt pad has a top surface 35. It should be understood that a number of devices can be substituted in place of the shot cup 25. Usually, the replacement of choice will be a paper wad which is familiar to those skilled in the art. There are many other commercially available paper wad configurations which could be substituted for the shot cup. The selection of the appropriate paper wad configuration would be based, in large measure, on the gun powder type 21, the crimp employed, the primer 23, and the ultimate end use for the apparatus 10.

A friable capsule generally indicated by the numeral 40 is detachably mounted in the void 20 at the second end of the casing 12. The friable capsule has a first end 41, a second end 42, and a longitudinal axis which is indicated by the line labeled 43. The friable capsule further has an outside surface 44 which is conformably dimensioned to be acted upon by the rifling of a conventionally designed gun barrel, not shown, the rifling imparting a spin to the apparatus 10 about the longitudinal axis 43. As earlier discussed, this longitudinal spin is desirable inasmuch as it is used to stabilize the apparatus 10 in flight for purposes of decreasing the amount of drag which will act upon the apparatus. The outside surface 44 mounts a rotating band 45 which is acted upon by the rifling to impart the longitudinal spin to the friable capsule. The friable capsule has an inside surface 46 which defines a chamber or void 50.

The friable capsule 40 is manufactured out of a composition which becomes rapidly pliable, or melts, when it is exposed to the heat generated by the impact of the apparatus 10 with a preselected target, not shown. The pliable capsule material forms to, or otherwise adheres to the impact area and thus preserves the heat energy localized at the point of impact for the purpose of weakening the surface of the target. As should be appreciated, the heat energy so localized, is quite effective in weakening targets which are manufactured out of metal The preferred material of construction for the friable capsule is polyvinylchloride (PVC). It should be understood that PVC is lightweight, yet strong enough to withstand the forces exerted on it when it is propelled out of the shotgun, PVC possessing a tensile strength of 5,000–9,000 PSI, and a Rockwell Hardness of R110–R120. Furthermore, it is well known that PVC experiences heat distortion, or otherwise becomes pliable at relatively low temperatures as compared with other substantially similar materials, and is easily machined or otherwise formed to shape.

The chamber 50 has an orifice 51 which defines the opening to the chamber. A plug 52 is conformably dimensioned to be received slidably in interlocking receipt with the orifice for purposes of mounting a projectile, generally indicated by the numeral 60 internally of the chamber. An orifice or channel 53 is formed substantially centrally of the plug 52 and is operable to permit air to escape past the plug 52 when the plug is inserted into occluding relation relative to the chamber 50.

As best seen by reference to FIG. 5A and 6A, a single penetrator 61 which is manufactured out of hardened steel has a main body 62 which is dimensioned to be matingly received internally of the chamber 50. The plug 52 and a spacer 53, which is manufactured out of a piece of cardboard which is approximately 1/16 inch in thickness, secures the single penetrator in a fixed position internally of the chamber until it is released from the friable capsule 40 after impact with a hardened target, not shown. The single penetrator 61 is manufactured out of tool steel which has been hardened using conventional techniques to a Rockwell Hardness of approximately R45–R50. Furthermore, it should be understood that the combined weight of the single penetrator, the casing 12, the friable capsule 40, the plug 52, the spacer 53, and the shot cup 25 is approximately 350 grains or 22.68 grams. The friable capsule mounting the single penetrator is propelled out of the muzzle of the shotgun, not shown, at a velocity of approximately 1780 Ft/Second and at a muzzle energy of approximately 2463 Ft/lbs. This muzzle velocity and muzzle energy causes the friable capsule mounting the single penetrator to pierce a target composed of a ⅜ inch thick 1018 steel plate when it is fired at a range of approximately 100 yards.

SECOND FORM

As best illustrated by reference to FIGS. 5B and 6B, the friable capsule 40 can be adapted to receive a lead slug 70. The lead slug has a main body 71, a forward portion 72, and a rearward portion 73. Formed substantially centrally of the main body 71 and adjacent to the rearward portion 72 is a cavity 74. The cavity 74 receives a filler material which will hereinafter be discussed in greater detail The apparatus 10 which is adapted to deliver the lead slug has the same relative performance characteristics as that earlier discussed with respect to the single penetrator 61, with the exception that the depth of penetration and the expansion rate of the lead slug, which will ultimately determine the size of the hole produced by the lead slug, will be controlled, to a certain extent, by the lead alloy composition employed. It should be understood that the utilization of a substantially harder lead alloy will generally have the effect of causing the lead slug to more deeply penetrate the target, and a softer lead alloy will conversely cause the lead slug to penetrate to shallower depth. For example, the penetration characteristics of the apparatus mounting a lead slug, the apparatus weighing 350 grains or 22.68 grams which has been fired at a distance of 100 yards at a preselected target can penetrate a target composed of a ⅛ inch thick 1018 steel plate. Alternatively, the apparatus can penetrate a target composed of a 1/16 inch 1018 steel plate, or 4 inches of pine boards when it is fired at the preselected target at a range of approximately 50 yards.

THIRD FORM

The third form of the apparatus 10 which is best seen by reference to FIGS. 5C and 6C, is adapted to mount a plurality of projectiles herein illustrated as a multiplicity of round shot 80. Each of the shot 80 has a spherical main body 81. Each of the shot further is disposed in a predetermined pattern internally of the chamber 50 by the filler material which will hereinafter be discussed in greater detail. The shot, which typically are manufactured out of hardened steel, are propelled out of the shotgun at approximately the same velocity and muzzle energy as heretofore discussed with respect to the single penetrator 61. An apparatus mounting the round shot, for example, can penetrate a target composed of a 1/16 inch thick 1018 steel plate when it is fired at a range of 100 yards. Furthermore, the shot will, upon passing through and traveling a distance three feet past the preselected target, disperse into a pattern which has a diameter of approximately 24 inches. The size of the pattern, and the depth of penetration is controlled, in large measure, by the filler material, which will hereinafter be discussed in greater detail. Furthermore the spherical main body 81 of the individual shot disposed along the longitudinal axis 43 and most closely mounted to the first end 41 of the friable capsule 40 can be varied in size for purposes of further controlling the size of the dispersion pattern.

FOURTH FORM

The fourth form of the apparatus 10 is best illustrated by reference to FIGS. 2 and 3. A friable capsule 40 is adapted to mount a multiple penetrator which is generally indicated by the numeral 90. The multiple penetrator has a single substantially centrally disposed penetrator 91 which is mounted in substantial registry with the longitudinal axis 43. The centrally disposed penetrator is surrounded by six peripherally disposed penetrators 92. The multiple penetrator is manufactured out of approximately the same material as that previously discussed with respect to the single penetrator 61. It similarly is hardened to the approximate Rockwell Hardness of the single penetrator. The multiple penetrator is mounted in a preselected pattern, which is best illustrated by reference to FIG. 3, internally of the chamber 50 by the filler material which will hereinafter be discussed in greater detail. The performance characteristics of the multiple penetrator are substantially identical to that of the single penetrator. Similarly, the relative size of the dispersion pattern produced by the multiple penetrator after it has passed through a preselected target is substantially identical to that produced by the round shot 80, that is, the multiple penetrator will disperse into a pattern which has a diameter of approximately 24 inches after it has penetrated, and thereafter moves past the preselected target a distance of approximately 3 feet. It should be understood, of course, that the depth of penetration and the diameter of the dispersion pattern can be varied somewhat by employing filler materials of various compositions.

FIFTH FORM

The fifth form of the apparatus 10 is best seen by reference to FIGS. 5D and 6D. The friable capsule 40 is conformably dimensioned to mount a mini-ball, which is generally indicated by the numeral 100. The mini-ball has a main body 101 which has formed therein a pair of transversely disposed circumscribing groove 102. The mini-ball is mounted internally of the friable capsule by the plug 52, and the spacer 53 which is received in interlocking receipt therewith. The mini-ball has approximately the same performance characteristics as the single penetrator 61 with the exception that its penetration characteristics will vary in accordance with the characteristics of its composition. For example, if the mini-ball is manufactured out of relatively hard material, it will achieve a greater depth of penetration than if the mini-ball were manufactured out of a composition of relatively soft material.

SIXTH FORM

The sixth form of the apparatus 10 is best seen by reference to FIGS. 5E and 6E. As shown therein the friable capsule 40 is conformably dimensioned to mount a modified single penetrator generally indicated by the numeral 110. The modified single penetrator has a main body 111 which has formed therein a longitudinally disposed shaft or channel 112 which is adapted to receive a source of lead 113. The modified single penetrator has all the same relative performance characteristics of the single penetrator 61. The modified single penetrator furthermore is held internally of the chamber 50 by a plug 52 and a spacer 53 which are conformably dimensioned for interlocking receipt therewith.

SEVENTH FORM

The seventh form of the apparatus 10 is best illustrated by reference to FIGS. 5F and 6F. As shown therein the friable capsule 40 mounts a lead slug housed in a steel jacket generally indicated by the numeral 120. The lead slug 121 has a longitudinally disposed shaft 122 which has a first end 123 and a second end 124. Affixed to the first end 123 is a pointed head 125 which is also manufactured out of lead. Received slidably about the shaft 123 is a rigid jacket 130 which can be manufactured out of steel, plastic or other deformable material. The steel jacket 130 has a main body 131 that has a forward cutting edge 132, a rearward cutting edge 133 and a centrally disposed passageway 134. The lead slug housed in the steel jacket has the same relative performance characteristics as the single penetrator 61 with the exception that the steel jacket operates in a manner to prevent the lead slug 121 from splaying after impact with the target. This is extremely important in those instances where the apparatus 10 is utilized for hunting purposes inasmuch as it minimizes damage to the surrounding tissue of the animal which is struck by the apparatus Furthermore, it should be understood that the steel jacket 130 can be reversed, that is, the rearward cutting edge can be placed in facing mating engagement with the pointed head 125 of the lead slug 121. In this configuration, the apparatus will achieve increased penetration of the preselected target. The lead slug housed in a steel jacket is held internally of the friable capsule 40 by a plug 52 and a spacer 53 which are conformably dimensioned for interlocking receipt therewith.

A filler material, generally indicated by the numeral 140, is adapted to mount the round shot 80 and the multiple penetrator 90 in a preselected pattern internally of the chamber 50. The filler material is also operable to control the size of the dispersion pattern and the depth of penetration of the round shot and the multiple penetrators, when the friable capsule 40 releases these projectiles upon impact with the target. It should be understood that the filler material is manufactured out of a composition which becomes rapidly pliable or melts when it is exposed to the heat which is generated when the apparatus 10 strikes the target. This filler material thus operates in a fashion similar to the material which makes up the friable capsule 40, that is, the filler material, which has become pliable, adheres to the target in the area of impact thus preserving the heat of impact localized. This heat energy, of course, causes the target to become weakened and thus permits the various projectiles 60 released from the friable capsule to achieve improved projectile penetration of the preselected target.

The filler material can be composed of various compositions depending upon the size of the dispersion pattern desired or the depth of penetration required. It has been discovered that two filler materials are quite successful in this regard. More particularly, the applicant has discovered that a silicone elastomer manufactured by the Dow Corning Company under the Trademark "Syl Gard" (TM) and a red epoxy casting compound manufactured by the Dexter Corp. under the trademark "Hy-Sol" (TM) can be effectively utilized for this purpose.

OPERATION

The operation of the described embodiments of the present invention is believed to be readily apparent and is briefly summarized at this point.

The projectile delivery apparatus 10 has a friable capsule 40 which releasably mounts a projectile 60 having a predetermined launch weight. The friable capsule retains the launch weight of the projectile intact until impact with a preselected target, not shown. As earlier discussed, the impact of the friable capsule 40 with the target generates heat energy which is effective in causing the friable capsule 40 and the filler material 140 to become rapidly pliable. In this state, the pliable filler material and the friable capsule adhere to the target and thus preserve the heat energy localized at the point of impact, the heat energy so localized weakens the target, and thus permits the projectile 60 to achieve improved penetration of the target.

Therefore, the projectile delivery apparatus 10 of the subject invention is adapted for use against a wide variety of different targets, the apparatus designed to penetrate the selected target to achieve predetermined objectives. The apparatus can be fired from a shotgun of conventional design, thereby permitting the shotgun to become a more effective close assault weapon for use in various tactical situations, and can be manufactured and sold at a relatively nominal cost when compared with prior art apparatuses which are designed for essentially the same purposes.

Although the invention has been herein shown and described in what is conceived to be the most practical and preferred embodiments, it is recognized that departures may be made therefrom within the scope of the invention which is not to be limited to the illustrative details disclosed.

Having described my invention, what I claim as new and desire to secure by Letters Patent is:

1. A projectile apparatus which enhances the penetration characteristics of a projectile, the apparatus propelled from a firearm at a preselected target, comprising:

a centrally disposed projectile having a predetermined launch weight and a plurality of smaller projectiles surrounding said centrally disposed projectile;

a friable capsule having a longitudinal axis and an internal chamber, the internal chamber disposed in substantial coaxial alignment with the longitudinal axis and receiving the projectiles to be delivered secured internally of the chamber in a predetermined pattern, the friable capsule enclosing the projectiles for traversing the distance from the firearm to the target and retaining the launch weight of the projectiles intact; and an epoxy filler material mounting the plurality of projectiles in a fixed position in the internal chamber and further controlling the dispersion pattern and the depth of penetration of the smaller projectiles when the friable capsule releases the projectiles upon impact with the target, and wherein impact of the friable capsule with the target generates heat, and wherein the friable capsule and the filler material become rapidly pliable upon exposure to the heat generated by said impact whereby the pliable capsule and filler material preserve the heat energy localized at the point of impact while releasing the projectiles from the capsule to achieve enhanced penetration of the target by passing the projectiles through the weakened point of impact of the target.

2. A projectile delivery apparatus which enhances the penetration characteristics of a projectile, the apparatus propelled from a firearm at a preselected target, comprising:

a centrally disposed projectile having a predetermined launch weight and a plurality of smaller projectiles surrounding said centrally disposed projectile;

a friable capsule having a longitudinal axis and an internal chamber, the internal chamber disposed in substantial coaxial alignment with the longitudinal axis and receiving the projectiles to be delivered secured internally of the chamber in a predetermined pattern, the friable capsules enclosing the projectiles for traversing the distance from the firearm to the target and retaining the launch weight of the projectiles intact; and a silicone elastomer filler material mounting the plurality of projectiles in a fixed position in the internal chamber and further controlling the dispersion pattern and the depth of penetration of the smaller projectiles when the friable capsule releases the projectiles upon impact with the target, and wherein impact of the friable capsule with the target generates heat, and wherein the friable capsule and the filler material becomes rapidly pliable upon exposure to the heat generated by said impact whereby the pliable capsule and filler material preserve the heat energy localized at the point of impact while releasing the projectiles from the capsule to achieve enhanced penetration of the target by passing the projectiles through the weakened point of impact of the target.

3. A projectile delivery apparatus for enhancing the penetration characteristics of a projectile and which is fired from a firearm at a target and wherein the firearm of selection is a shotgun of conventional design, the apparatus comprising:

a shotgun cartridge for propelling the apparatus out of the firearm and towards the target, the shotgun cartridge having a casing with a first end mounting a primer and a propellant and a second end defining a void;

a shot cup slidably received in the void and disposed between the propellant and the second end of the casing;

a felt pad slidable received in the void and mounted in facing engagement with the short cup, said felt pad disposed between the shot cup and the second end of the casing;

a friable capsule manufactured from polyvinylchloride and having an axially symmetrical outside surface, a longitudinal axis, and defining a chamber disposed in substantially coaxial alignment with the longitudinal axis thereof, said friable capsule releasably mounted internally of the void on the second end of the casing, the friable capsule upon impact with the target generating heat energy and wherein said friable capsule upon exposure to said heat energy becomes rapidly pliable thereby substantially preserving the heat energy generated by impact localized at the point of impact to weaken the target at the point of impact;

a centrally disposed projectile having a predetermined launch weight to be delivered to the target enclosed in the chamber of the friable capsule, and a plurality of smaller projectiles disposed in a preselected pattern in the chamber, and wherein a silicone elastomer filler material mounts the plurality of projectiles in the selected pattern and is operable to a control the dispersion pattern and depth of penetration of the smaller projectile when the friable capsule releases the smaller projectiles for impact with the weakened target, the friable capsule retaining the launch weight of the projectiles intact until delivery at the target, the silicone elastomer becoming rapidly pliable upon exposure to the heat generated by impact thereby substantially preserving the heat generated by impact localized at the point of impact to weaken the target, the friable capsule and filler material releasing the projectiles upon impact into a weakened target thus allowing the projectiles to achieve enhanced penetration of the target.

* * * * *

UNITED STATES PATENT AND TRADEMARK OFFICE

CERTIFICATE OF CORRECTION

PATENT NO. : 4,913,054

DATED : April 3, 1990

INVENTOR(S) : Donald W. Petersen

It is certified that error appears in the above—identified patent and that said Letters Patent is hereby corrected as shown below:

Column 3, Line 62, cancel "513" and insert -- 5 - --;

Column 8, Line 28, after "apparatus" insert a period -- . --;

Column 9, Line 55, cancel "intact" and insert -- in tact --;

Column 10, Line 20, cancel "intact" and insert -- in tact --;

Column 10, Line 51, cancel "short" and insert -- shot --.

Signed and Sealed this

Twenty-first Day of May, 1991

*Attest:*

HARRY F. MANBECK, JR.

*Attesting Officer*

*Commissioner of Patents and Trademarks*